US011773676B2

(12) United States Patent
Brown-Kerr et al.

(10) Patent No.: US 11,773,676 B2
(45) Date of Patent: Oct. 3, 2023

(54) WHIPSTOCK ASSEMBLY

(71) Applicant: OILTOOLSTEQ LTD, Aberdeen (GB)

(72) Inventors: William Brown-Kerr, Aboyne (GB); Andrew John Watson, Aberdeen (GB)

(73) Assignee: OILTOOLSTEQ LTD, Aberdeen (GB)

( * ) Notice: Subject to any disclaimer, the term of this patent is extended or adjusted under 35 U.S.C. 154(b) by 0 days.

(21) Appl. No.: 17/255,885

(22) PCT Filed: Jun. 28, 2019

(86) PCT No.: PCT/GB2019/051835
§ 371 (c)(1),
(2) Date: Dec. 23, 2020

(87) PCT Pub. No.: WO2020/002936
PCT Pub. Date: Jan. 2, 2020

(65) Prior Publication Data

US 2021/0372219 A1 Dec. 2, 2021

(30) Foreign Application Priority Data

Jun. 28, 2018 (GB) ..... 1810604

(51) Int. Cl.
*E21B 23/00* (2006.01)
*E21B 7/06* (2006.01)
*E21B 29/06* (2006.01)

(52) U.S. Cl.
CPC ..... *E21B 29/06* (2013.01); *E21B 7/061* (2013.01); *E21B 23/00* (2013.01)

(58) Field of Classification Search
CPC ..... E21B 7/061; E21B 23/00; E21B 29/06
See application file for complete search history.

(56) References Cited

U.S. PATENT DOCUMENTS 2,438,293 A 3/1948 Livingston
5,425,417 A 6/1995 Carter
(Continued)

FOREIGN PATENT DOCUMENTS

EP 0685628 A1 12/1995
GB 2538358 B 7/2017
(Continued)

OTHER PUBLICATIONS

International Search Report and Written Opinion, International Patent Application No. PCT/GB2019/051835, dated Sep. 11, 2019 (13 pages).

(Continued)

*Primary Examiner* — Robert E Fuller
*Assistant Examiner* — Lamia Quaim
(74) *Attorney, Agent, or Firm* — Hamre, Schumann, Mueller & Larson, P.C.

(57) ABSTRACT

A whipstock assembly (12) for use in deviating a wellbore (10) of a well is disclosed, the whipstock assembly comprising a whipstock (18) having an inclined deflection surface (20); a milling assembly (14) comprising a mill (16) for milling a window (49) in a wall (48) of the wellbore and forming a rathole (50) extending from the wellbore; a releasable joint (22; 122) by which the milling assembly is releasably connected to the whipstock, so that the milling assembly can be separated from the whipstock within the wellbore and subsequently deflected towards the wellbore wall by the deflection surface of the whipstock; at least one sensor (188) provided in the milling assembly, for measuring at least one parameter of the rathole, the at least one parameter relating to a trajectory of the rathole; and a communication device (190) associated with the at least one sensor, for communicating data relating to the at least one parameter to an operator of the milling assembly.

18 Claims, 7 Drawing Sheets

(56) References Cited

U.S. PATENT DOCUMENTS

| | | | | |
|---|---|---|---|---|
| 2002/0074121 | A1 | 6/2002 | Schick | |
| 2002/0096325 | A1 | 7/2002 | Sonnier | |
| 2002/0170713 | A1* | 11/2002 | Haugen | E21B 17/07 166/117.6 |
| 2006/0065395 | A1* | 3/2006 | Snell | E21B 47/01 175/45 |
| 2010/0012322 | A1 | 1/2010 | McGarian | |
| 2011/0253387 | A1 | 10/2011 | Ervin | |
| 2014/0131036 | A1* | 5/2014 | Huval | E21B 47/13 175/45 |
| 2014/0158351 | A1 | 6/2014 | Palmer | |
| 2015/0101863 | A1* | 4/2015 | Jeffryes | E21B 47/0228 175/24 |
| 2015/0218934 | A1* | 8/2015 | Turner | E21B 47/02 175/45 |
| 2016/0145956 | A1 | 5/2016 | Dahl et al. | |
| 2018/0340410 | A1* | 11/2018 | Rivera-Rios | E21B 44/02 |
| 2019/0292897 | A1* | 9/2019 | Costa de Oliveira | E21B 17/10 |

FOREIGN PATENT DOCUMENTS

| | | | |
|---|---|---|---|
| WO | 2009/137537 | A2 | 11/2009 |
| WO | 2017/099780 | A1 | 6/2015 |
| WO | 2017/086936 | A1 | 5/2017 |
| WO | 2017/100939 | A1 | 6/2017 |
| WO | 2017/105437 | A1 | 6/2017 |

OTHER PUBLICATIONS

Search Report issued in GB1810604.7, dated Nov. 19, 2018 (2 pages).

* cited by examiner

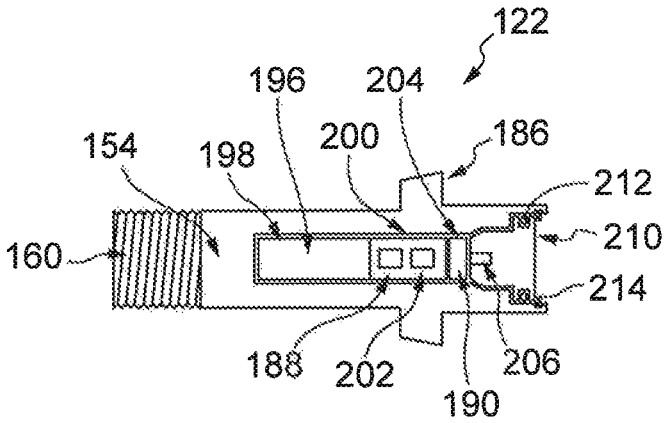
Fig. 16
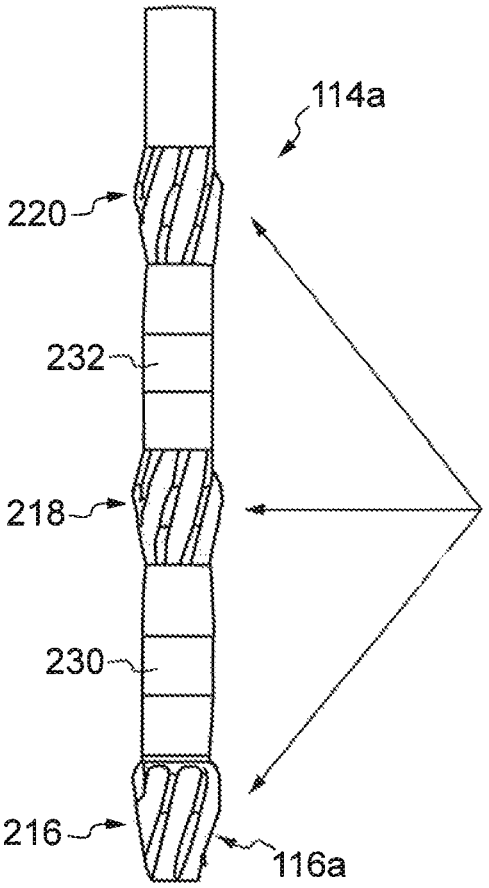
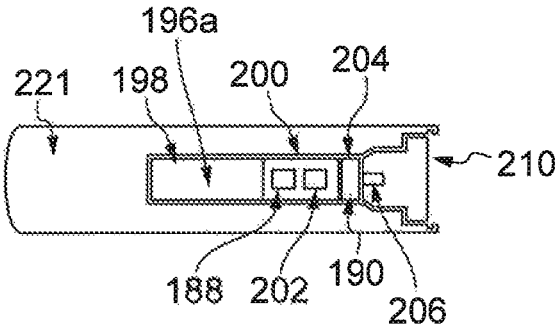
Fig. 17A
Fig. 17

WHIPSTOCK ASSEMBLY

The present invention relates to a whipstock assembly. In particular, but not exclusively, the present invention relates to a whipstock assembly for use in deviating a wellbore of a well, the whipstock assembly comprising a whipstock having an inclined deflection surface, a milling assembly comprising a mill for milling a window in a wall of the wellbore and forming a rathole extending from the wellbore, and a releasable joint by which the milling assembly is releasably connected to the whipstock. The present invention also relates to a releasable joint for releasably connecting a milling assembly to a whipstock, a stabiliser of a milling assembly, and a method of deviating a wellbore of a well and verifying a trajectory of the deviation.

In the oil and gas exploration and production industry, wellbore fluids comprising oil and/or gas are recovered to surface through a wellbore which is drilled from surface. The wellbore is lined with metal wellbore-lining tubing, which is known in the industry as 'casing', which is cemented in place within the wellbore. The casing serves numerous purposes, including: supporting the drilled rock formations; preventing undesired ingress/egress of fluid; and providing a pathway through which further tubing and downhole tools can pass.

It is often desirable to deviate or sidetrack an existing wellbore. The wellbore can be deviated prior to the installation and cementation of casing (when it is referred to as being 'open hole'), or after installation and cementation of casing (when it is it referred to as being 'cased'). Reasons for sidetracking a well include to form a lateral wellbore extending to a new geological target, and when a downhole component, known in the industry as a 'fish', is unintentionally left in the wellbore and blocks it.

Deviating or sidetracking a well involves the milling of a window in a wall of the existing, main wellbore. In a cased hole, the window will be formed through the casing and cement located in the main wellbore. In an open hole, the window will simply be formed in the surrounding rock formation of the wellbore wall. Milling of the window requires the positioning of a special mill guiding device known as a 'whipstock' in the main wellbore.

The whipstock has a deflection surface that is inclined relative to a main axis of the wellbore, forming a ramp which serves for deflecting and so guiding a mill of a milling assembly out from the main wellbore, through the casing wall and cement (if applicable), to form the window. A 'rathole' is then created and extended to accommodate the next operation.

The whipstock forms part of a whipstock assembly which is made up on a drill floor of a rig, by connecting the milling assembly to the whipstock. This is typically achieved using a component known as a shear bolt. The whipstock assembly is then lowered into the main wellbore and placed at a desired location. If the main wellbore is near vertical then the whipstock assembly is orientated to a preferred azimuth (rotational direction relative to a fixed point, which may be true north). If the main wellbore is not near vertical then the whipstock assembly is orientated to a preferred angle (relative to the plane perpendicular to the wellbore axis). Once the whipstock assembly has been placed at the desired location and orientation, an anchor or packer associated with the whipstock is set, which secures the whipstock in place within the main wellbore. The milling assembly is then disconnected from the whipstock by applying an axial load on the milling assembly which is sufficient to break the shear bolt. The window milling procedure can then commence using the milling assembly.

In one prior procedure for deviating a wellbore, a starter mill on a lower end of a milling assembly is used to cut an initial window through the casing wall (in a cased hole) which is opposite the deflection surface of the whipstock. A work string carrying the milling assembly (including the starter mill) is then removed from the wellbore. A drill string having a window mill is then run-into the wellbore and deflected through the window by the whipstock, before being rotated to enlarge the size of the window. The drill string may then have to be removed from the wellbore, before being run-in again carrying a different type of window mill. The further window mill performs an additional milling operation on the window, which is required in order to ensure that the window through the side of the casing has been satisfactorily formed. This procedure requires multiple round trips of a tubing string in order to accomplish the desired objective.

Another prior procedure involves the use of a 'single trip' whipstock assembly, which enables a number of steps to be carried out in one trip into the well. Typically, a single trip milling assembly will be provided which comprises a starter mill that forms the initial window, and at least one other mill, known as a reaming mill, which is used to dress the window that has been cut in the casing using the starter mill.

In both prior procedures, the milling assembly continues to move down the whipstock following formation of the window, creating a new borehole which is known in the industry as a 'rathole'. The rathole departs from the main wellbore, and is extended a sufficient distance from the main wellbore until the reaming/window mill is brought to a position where it engages and enlarges and/or dresses the window. In some scenarios, it may be desirable to extend the rathole a substantial distance, in order to accommodate the bottom hole assembly (BHA) used in the next operation, such as a rotary steerable system. On completion of the rathole, the milling assembly is retrieved to surface, and the mills are inspected and 'gauged', to determine if the window has been properly created. Typically, the gauges are metal rings of a predetermined diameter that are passed over the mills. If the gauges do not pass over the mills and the wear on the mills appears to be normal, then it can be assumed that the window has been properly created. If the gauges are able to pass over the mills, this is indicative of the mills having been worn down too much and the window may not be formed correctly.

A problem which can be encountered when drilling a deviated wellbore, and particularly when forming a rathole, is determining the final position of the rathole. Specifically, the rathole is designed to deviate away from the main (or 'mother') wellbore, and also to extend in a preferred azimuthal direction. Typically, the final position of the rathole can only be confirmed after a new lateral wellbore, or an extension of the main wellbore, has been drilled extending from the rathole. This is achieved using a new drilling assembly containing directional sensors which can measure the inclination and azimuth of the lateral wellbore.

Unfortunately, the final position of the rathole can only be determined once the directional sensors of the new drilling assembly are at the required location (total depth—TD—of the rathole) to take directional measurements. This may involve extending the new wellbore significantly as the directional sensors may be some distance from the drill bit.

Accordingly, a determination that the rathole has not followed a preferred trajectory, in terms of inclination and/or azimuth, can only be made at a late stage in the procedure, and following drilling and extension of the rathole.

Another issue that may be encountered when using a whipstock to deviate from the existing wellbore is that the rathole does not correctly deviate away from the main wellbore. For example, the starter mill may not be correctly deflected by the whipstock, and may mill through the deflection surface, passing along an incorrect trajectory. Alternatively, the starter mill may be correctly deflected, but the mill may then deviate from its planned trajectory, passing parallel to the main wellbore or along some other unplanned trajectory. Again, these issues will not be discovered until the new wellbore has been extended using a new drilling assembly which contains directional sensors.

If a rathole is found not to be following the preferred trajectory, then a new drilling operation may have to be performed to correct the problem. This can be very costly and time-consuming. Further, the correction process may result in a complete change of the borehole assembly, which results in substantial loss of rig time.

Another issue that may be encountered, if the window has not been created correctly or the rathole has not followed the preferred trajectory, is the possible damage to equipment used in subsequent operations, such as damage to rotary steerable tools.

Certain prior whipstock assemblies are disclosed in International Patent Publication Nos. WO-2017/086936A1 and WO-2017/099780A1, and US Patent Publication Nos. US-2014/0131036A1 and US-2002/0096325A1. The assemblies disclosed in these documents comprise sensors which are provided to orient a whipstock within a wellbore. The sensors are spaced a significant distance from a lead (or starter) mill, typically in a measurement while drilling (MWD) unit provided uphole of a milling assembly incorporating the mill. The significant distance between the lead mill and the sensors is such that no useful information can be obtained as to a trajectory of a rathole milled using the lead mill until it is too late to change the trajectory.

Another prior whipstock assembly is disclosed in US Patent Publication No. US-2014/0158351A1. In this case, pre-positioned tags are included in a whipstock, and detected by sensors contained within the mill assembly when they pass the tags. These tag sensors however do not offer well bore trajectory measurements, they simply detect the tags on the whipstock.

According to a first aspect of the present invention, there is provided a whipstock assembly for use in deviating a wellbore of a well, the whipstock assembly comprising:

- a whipstock having an inclined deflection surface;
- a milling assembly comprising a mill for milling a window in a wall of the wellbore and forming a rathole extending from the wellbore;
- a releasable joint by which the milling assembly is releasably connected to the whipstock, so that the milling assembly can be separated from the whipstock within the wellbore and subsequently deflected towards the wellbore wall by the deflection surface of the whipstock;
- at least one sensor provided in the milling assembly, for measuring at least one parameter of the rathole, the at least one parameter relating to a trajectory of the rathole; and
- a communication device associated with the at least one sensor, for communicating data relating to the at least one parameter to an operator of the milling assembly.

The present invention enables the trajectory of a rathole to be measured during its formation, and data relating to the trajectory to be communicated to an operator of the milling assembly. If the trajectory is found to be correct then the rathole can be extended using a suitable milling/drilling assembly (to deviate the wellbore) with confidence that the rathole has been formed correctly and so that the extension is also on the correct trajectory. If however the trajectory is found to be incorrect, for example if one or both of the inclination and the azimuth is incorrect, then steps can be taken to correct the trajectory prior to extension of the rathole along the wrong trajectory. The present invention therefore provides significant advantages over prior procedures which do not enable verification of the trajectory prior to extension of a rathole.

Reference is made in this document to the deviation of a wellbore of a well. It will be understood that a wellbore may be deviated for various different reasons, including but not restricted to: forming a lateral wellbore extending from the wellbore (which may be a main wellbore) to a new geological target such as a hydrocarbon bearing formation spaced laterally from the wellbore; and when a downhole component (fish) has unintentionally been left in the wellbore and blocks it. Reference may also be made to the sidetracking of a wellbore, which term may be used interchangeably with deviation/deviating.

Reference is made in this document to a rathole. In the context of the present invention, a rathole should generally be taken to be a hole extending from the wellbore and which intersects with it. Where the wellbore is substantially vertical (or at least at a non-horizontal angle), the rathole will typically extend laterally of the wellbore. The rathole will typically extend a short distance, relative to a length of the wellbore. However, it will be understood that the reference to a rathole does not necessarily imply a restriction on a length of the rathole. The rathole will typically be of a smaller diameter than the wellbore, particularly where the wellbore has been lined with wellbore-lining tubing, such being necessary in order to allow passage of the mill which forms the window and the rathole. However, it will be understood that the reference to a rathole does not necessarily imply a restriction on a diameter of the rathole.

Reference is made in this document to the at least one sensor (and other components) being provided in the milling assembly. It will be understood that this should not necessarily be taken to mean that the at least one sensor is mounted within a structure of the milling assembly, and so that said sensor may, for example, be mounted on a surface of the milling assembly.

Reference is made in this document to a milling assembly comprising a mill for milling a window in a wall of a wellbore and forming a rathole extending from the wellbore. It will be understood that the milling assembly is not restricted to being used to form a window in a wellbore which has been lined with wellbore lining tubing (casing) and may be used in an open-hole situation, in which the window would be formed in a side wall of the wellbore. The reference to a milling assembly comprising a mill for milling a window in a wall of a wellbore should be interpreted accordingly.

The milling assembly may comprise the mill for milling the window (which may be a lead or starter mill); the releasable joint; an optional stabiliser; an optional at least one further mill spaced along the tubing from the lead mill; and tubing coupled to and serving for rotating the mill or mills. The at least one sensor may be provided in one or more of the (lead) mill, the releasable joint, the stabiliser, the at least one further mill, and/or the tubing. Where the milling assembly comprises a lead mill and at least one further mill, the milling assembly may consist of the lead mill, the further mill, and the components/equipment located between the mills.

The at least one sensor is preferably provided as close as is practicable to the (lead) mill. This may enable the provision of information relating to the rathole trajectory at an early stage, and so prior to milling of a relatively long length of rathole, as in prior whipstock assemblies.

The at least one sensor may be adapted to measure at least one of: an inclination of the rathole; and an azimuth of the rathole (i.e. a rotational direction of the rathole relative to a fixed point, which may be true north).

A plurality of sensors may be provided. Each sensor may be adapted to measure a different parameter of the rathole. A plurality of sensors may be provided for measuring the same parameter, which may provide a degree of redundancy and/or verification of parameter data. At least one sensor may be adapted to measure a further parameter, which may relate to the rock formation(s) surrounding the rathole, or some other parameter such as a parameter of fluid in the rathole.

The at least one sensor may also be for measuring at least one parameter of an extension of the rathole. The extension may form a lateral wellbore extending from the wellbore (which may be a main wellbore). The extension may effectively form a continuation of the wellbore, for example in circumstances where the wellbore has become blocked at a location which is further from the surface (and so deeper in the wellbore) than the whipstock, such as by a fish.

The at least one sensor may be selected from the group comprising: an accelerometer (which may be used for measuring angular tilt and so inclination of the rathole, for measuring inertia such as in directional milling/drilling, and/or for measuring vibration during milling/drilling operations); a temperature sensor; a magnetometer (which may be used for measuring fluctuations in the magnetic field e.g. in surrounding medium); a pressure sensor; a gyroscopic sensor (which may be used for measuring azimuth); a vibration monitoring sensor; a shock monitoring sensor; a sensor which measures at least one formation parameter, which may be selected from the group comprising gamma ray/radiation, porosity and density; and a resistivity sensor, which may be for measuring resistivity of the surrounding formation, and/or which may be utilised for measuring resistivity in metal (e.g. casing) surrounding the milling assembly. Where there are a plurality of sensors, the sensors may be selected from this group.

At least one sensor may measure a milling parameter, which may be a parameter relating to a milling procedure. Measurement of the milling parameter may be achieved using a vibration monitoring sensor and/or a shock monitoring sensor, which may measure vibration and/or shock loading on or in the mill. Excessive vibration of or in the mill, for example due to too high a weight and/or torque being applied, may be undesirable. In particular, such may result in a poor cut of a window, with edges or ledges that are likely to cause problems when a tool or tubing is subsequently passed from the wellbore into the rathole. A sensor for measuring one or more of rotation, torque and weight of or on the mill may be provided.

The whipstock assembly may comprise a mounting unit (or module) containing the at least one sensor, and optionally also the communication device. The mounting unit may be releasably mountable to a component of the milling assembly. This may provide the advantage that the at least one sensor, and optionally also the communication device, can easily be released from the milling assembly, for example for maintenance or replacement purposes, and/or for retrieving the data. The mounting unit may comprising a housing containing the at least one sensor, and optionally also the communication device. The housing may be releasably mountable to the milling assembly component, such as via a suitable connection, which may be a threaded connection. The housing may comprise a housing body containing the at least one sensor, and optionally also the communication device, and a housing cap (or plug) which is mountable on the housing body. The housing cap may be sealingly mountable to the housing body. This may serve for isolating the at least one sensor, and optionally also the communication device, from fluid exterior to the housing, which may be a wellbore fluid or fluids.

The releasable joint may comprise a first part mounted to the milling assembly and a second part mounted to the whipstock. The releasable joint may be a shear bolt or shear pin. One of the first and second parts may be a bolt or pin portion, and the other one of the first and second parts may be a head portion. The releasable joint may comprise a shear zone (or a zone or line of weakness). The releasable joint may be adapted to shear or break in the shear zone, which may occur on application of a predetermined load (which may be an axially directed load). This may serve for disconnecting the milling assembly from the whipstock. The shear zone may be provided on or by the head portion of the releasable joint. On shearing, the joint may separate into a first section comprising a part of the head portion, and a second section comprising a further part of the head portion and the bolt portion. The further part of the head portion and the bolt portion may be coupled together, such as by a threaded connection.

The at least one sensor, and optionally also the communication device, may be mounted to or within the releasable joint. This may be a convenient location, as conventional milling assemblies require a port or aperture in which a releasable joint is located, and so such mounting may only require minimal (if any) modification to the milling assembly. The at least one sensor, and optionally also the communication device, may be mounted to or within the first part of the releasable joint. Where the whipstock assembly comprises a mounting unit, the mounting unit may be mounted to or within the releasable joint, particularly the first part of the releasable joint. The releasable joint may form the component of the milling assembly mentioned above.

The at least one sensor, and optionally also the communication device, may be mounted to or within the mill, such as in a port, recess or aperture in a body of the mill. Where the whipstock assembly comprises a mounting unit, the mounting unit may be mounted to or within the mill. The mill may form the component of the milling assembly mentioned above.

The mill of the milling assembly may be a starter mill, which may be provided at or may form a leading end of the milling assembly. The leading end may be disposed furthest from the surface during use. The milling assembly may comprise at least one window mill, which may be spaced along the assembly from a leading end. The at least one sensor, and optionally also the communication device, may be mounted to or within: a) the starter mill; and b) the at least one window mill. At least one sensor, and optionally also a communication device, may be mounted to or within both the starter mill and at least one window mill of the assembly.

The milling assembly may comprise at least one stabiliser. The stabiliser may serve for mechanically stabilising the milling assembly, and may space tubing of the milling assembly from the wall of the wellbore and/or casing or other tubing disposed within the wellbore, especially during rotation of the milling assembly (or a part of the assembly) to perform a milling operation. The at least one sensor, and optionally also the communication device, may be mounted to or within the stabiliser such as in a port, recess or aperture in a body of the stabiliser. The milling assembly may comprise a plurality of stabilisers. At least one sensor, and optionally also a communication device, may be mounted to or within each stabiliser. Where the whipstock assembly comprises a mounting unit, the mounting unit may be mounted to or within the stabiliser. The stabiliser may form the component of the milling assembly mentioned above.

Where the whipstock assembly comprises a plurality of sensors, different sensors may be mounted to or within different components, which components may be selected from the releasable joint, mill and stabiliser discussed above.

The whipstock assembly may comprise a source of power for providing power to operate the at least one sensor and the communication device. The power source may be provided in the milling assembly. The power source may be a battery. Where the whipstock assembly comprises a mounting unit, the mounting unit may contain the power source. The housing of the mounting unit may contain the power source.

The whipstock assembly may comprise a data storage device associated with the sensor for storing the data. The data storage device may be provided in the milling assembly. The data storage device may be a processor comprising memory storage. The data storage device may be powered by the power source. Where the whipstock assembly comprises a mounting unit, the mounting unit may contain the data storage device. The housing of the mounting unit may contain the data storage device.

The communication device may be provided in the milling assembly. The communication device may comprise a communication interface, which may be associated with the data storage device, for receiving the data. The communication device may comprise a data transmitter for transmitting data to the operator. The data transmitter may be adapted to transmit data to the operator via an appropriate communication method, such as: fluid pressure pulses in fluid contained in the wellbore (e.g. mud pulse telemetry); and electromagnetic or acoustic/sonic telemetry (e.g. transmitted along a string of tubing coupled to the milling assembly). This may enable real-time data to be viewed at surface. The data transmitter may be associated with the communication interface, for receiving data from the data storage device. The communication interface may be adapted to be connected to a further data interface, which may be provided at surface, so that the data can be downloaded. The communication interface may be connectable to the further communication interface by a hard electrical connection, such as a pin/plug and socket connection. The communication interface may by connectable to a further communication interface by a non-contact method, including but not limited to an inductive coupling and an optical coupling.

The deflection surface of the whipstock may be inclined relative to a longitudinal axis of the milling assembly and/or wellbore. The whipstock may taper in a direction from a first end which is disposed closer to the milling assembly to a second end which is spaced away from the milling assembly. In this way, the mill is deflected towards the wall of the wellbore when the mill is translated in a direction towards the whipstock. The deflection surface may be hardened to resist milling by the milling assembly.

Reference is made in this document to the communication of data to an operator of the milling assembly. It will be understood that the operator will typically be a person skilled in the art of wellbore drilling/milling procedures. However, the reference to an operator should not be taken to imply any limitation on the person or the skills of the person involved. Equally, the data may be communicated to and monitored by computer implemented means such as a software programme running on suitable hardware, the software configured to assess the data. The reference to an operator should be interpreted accordingly.

According to a second aspect of the present invention, there is provided a releasable joint for releasably connecting a milling assembly to a whipstock, the releasable joint comprising:

- a first part adapted to be mounted to the milling assembly;
- a second part adapted to be mounted to the whipstock;
- a shear zone adapted to shear on application of a predetermined load, to separate the first part from the second part and so disconnect the milling assembly from the whipstock;
- at least one sensor for measuring at least one parameter of a well; and
- a communication device associated with the at least one sensor, for communicating data relating to the at least one parameter to an operator of the milling assembly;
- in which the at least one sensor and the communication device are provided in the first part of the releasable joint.

The at least one sensor may be for measuring at least one parameter of wellbore of a well. The at least one parameter may relate to a trajectory of the wellbore. The at least one sensor may be for measuring at least one parameter of a rathole extending from a wellbore of a well, the at least one parameter relating to a trajectory of the rathole.

Further features of the releasable joint may be derived from the text set out elsewhere in this document, particularly the text relating to the whipstock assembly of the first aspect of the invention.

According to a third aspect of the present invention, there is provided a mill of a milling assembly for use in a wellbore, the mill comprising:

- at least one sensor for measuring at least one parameter of the wellbore; and
- a communication device associated with the at least one sensor, for communicating data relating to the at least one parameter to an operator of the milling assembly.

The at least one parameter may relate to a trajectory of the wellbore. The milling assembly may be for use in forming a window in a wall of a wellbore and a rathole extending from the wellbore. The at least one sensor may be for measuring at least one parameter of the rathole, the at least one parameter relating to a trajectory of the rathole.

Further features of the mill may be derived from the text set out elsewhere in this document, particularly the text relating to the whipstock assembly of the first aspect of the invention.

According to a fourth aspect of the present invention, there is provided a stabiliser of a milling assembly for use in a wellbore, the stabiliser comprising:

- at least one sensor for measuring at least one parameter of the wellbore; and
- a communication device associated with the at least one sensor, for communicating data relating to the at least one parameter to an operator of the milling assembly.

The at least one parameter may relate to a trajectory of the wellbore. The milling assembly may be for use in forming a window in a wall of a wellbore and a rathole extending from the wellbore. The at least one sensor may be for measuring at least one parameter of the rathole, the at least one parameter relating to a trajectory of the rathole.

Further features of the stabiliser may be derived from the text set out elsewhere in this document, particularly the text relating to the whipstock assembly of the first aspect of the invention.

According to a fifth aspect of the present invention, there is provided a method of deviating a wellbore of a well and verifying a trajectory of the deviation, the method comprising the steps of:

- connecting a milling assembly to a whipstock using a releasable joint, to form a whipstock assembly comprising the milling assembly and the whipstock;
- deploying the whipstock assembly into the wellbore;
- positioning the whipstock at a desired location within the wellbore and subsequently disconnecting the milling assembly from the whipstock by releasing the releasable joint;
- translating the milling assembly within the wellbore in a direction towards the whipstock, so that a mill of the milling assembly is deflected towards a wall of the wellbore by a deflection surface of the whipstock;
- activating the mill to form a window in the wall of the wellbore, and subsequently forming a rathole extending from the wellbore;
- operating at least one sensor provided in the milling assembly whilst the milling assembly is located in the rathole to measure at least one parameter of the rathole, the at least one parameter relating to a trajectory of the rathole; and
- communicating data relating to the at least one parameter to an operator via a communication device associated with the at least one sensor, so that the trajectory of the rathole can be verified.

Further features of the method may be derived from the text set out elsewhere in this document, particularly the text relating to the whipstock assembly of the first aspect of the invention.

According to another aspect of the present invention, there is provided a milling assembly for a whipstock assembly having a use in deviating a wellbore of a well, the milling assembly comprising:

- a mill for milling a window in a wall of the wellbore and forming a rathole extending from the wellbore;
- a releasable joint by which the milling assembly can be releasably connected to a whipstock, so that the milling assembly can be separated from the whipstock within the wellbore and subsequently deflected towards the wellbore wall by the deflection surface of the whipstock;
- at least one sensor provided in the milling assembly, for measuring at least one parameter of the rathole, the at least one parameter relating to a trajectory of the rathole; and
- a communication device associated with the at least one sensor, for communicating data relating to the at least one parameter to an operator of the milling assembly.

Further features of the milling assembly may be derived from the text set out elsewhere in this document, particularly the text relating to the whipstock assembly of the first aspect of the invention.

Embodiments of the present invention will now be described, by way of example only, with reference to the accompanying drawings, in which:

FIG. 16 is a side view of part of an alternative releasable joint, similar to that shown in FIG. 13;

FIG. 17 is a side view of a milling assembly of a whipstock assembly in accordance with an alternative embodiment of the present invention; and FIG. 17A is an enlarged view of part of the milling assembly shown in FIG. 17, illustrating a sensor and a communication device of the milling assembly.

Figure 1:
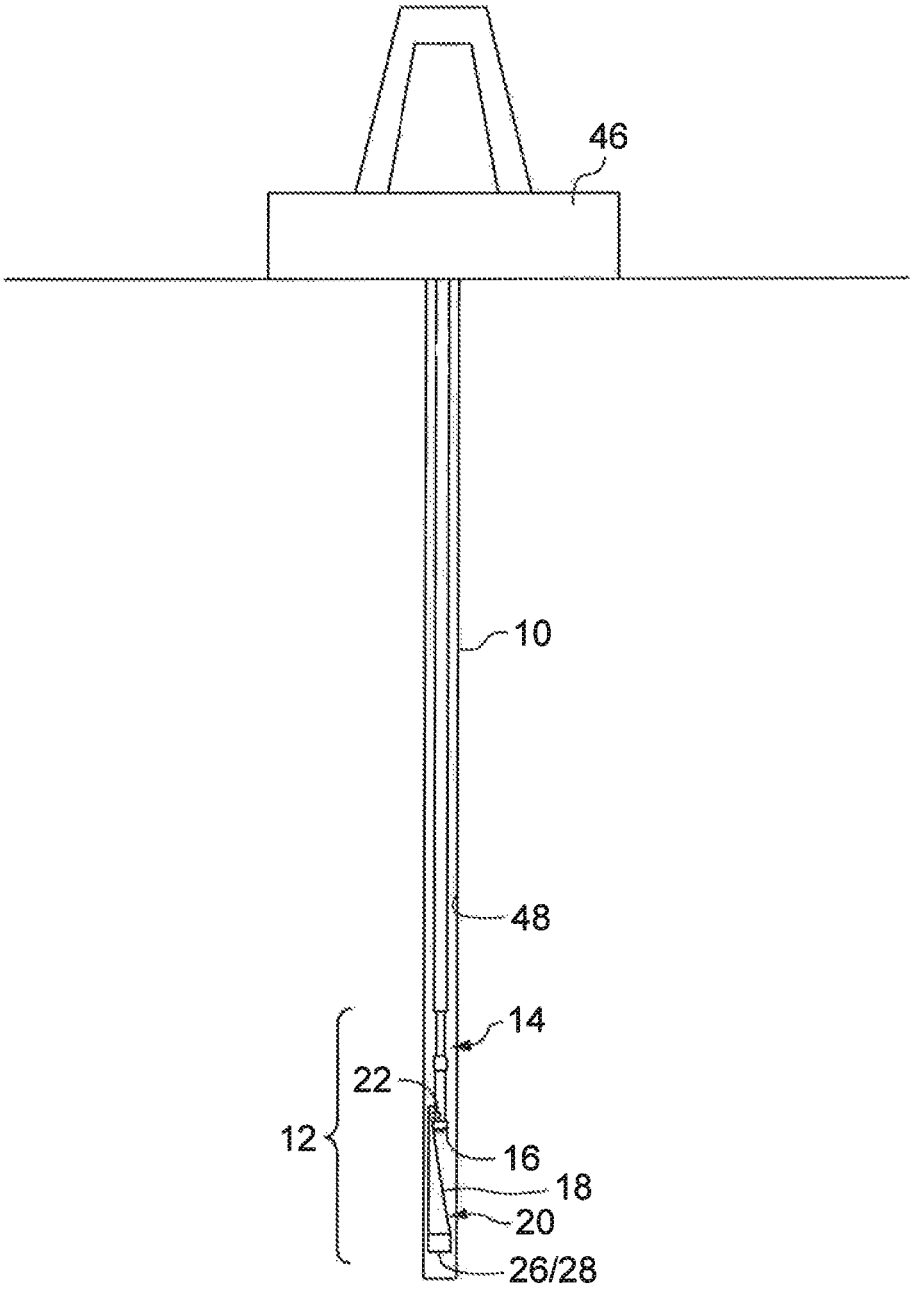
FIG. 1 is a schematic longitudinal sectional view of a wellbore of an oil and/or gas well, showing a whipstock assembly of a type known in the art located in the wellbore.

Turning firstly to FIG. 1, there is shown a schematic longitudinal sectional view of a wellbore 10 of an oil and/or gas well, with a whipstock assembly 12 of a type known in the art located in the wellbore. The whipstock assembly 12 comprises a milling assembly 14 comprising a mill 16 for milling a window in a wall of the wellbore 10 and forming a rathole extending from the wellbore. The whipstock assembly 12 also comprises a whipstock 18 having an inclined deflection surface 20, and a releasable joint 22 by which the milling assembly 14 is releasably connected to the whipstock 18.

Figure 2:
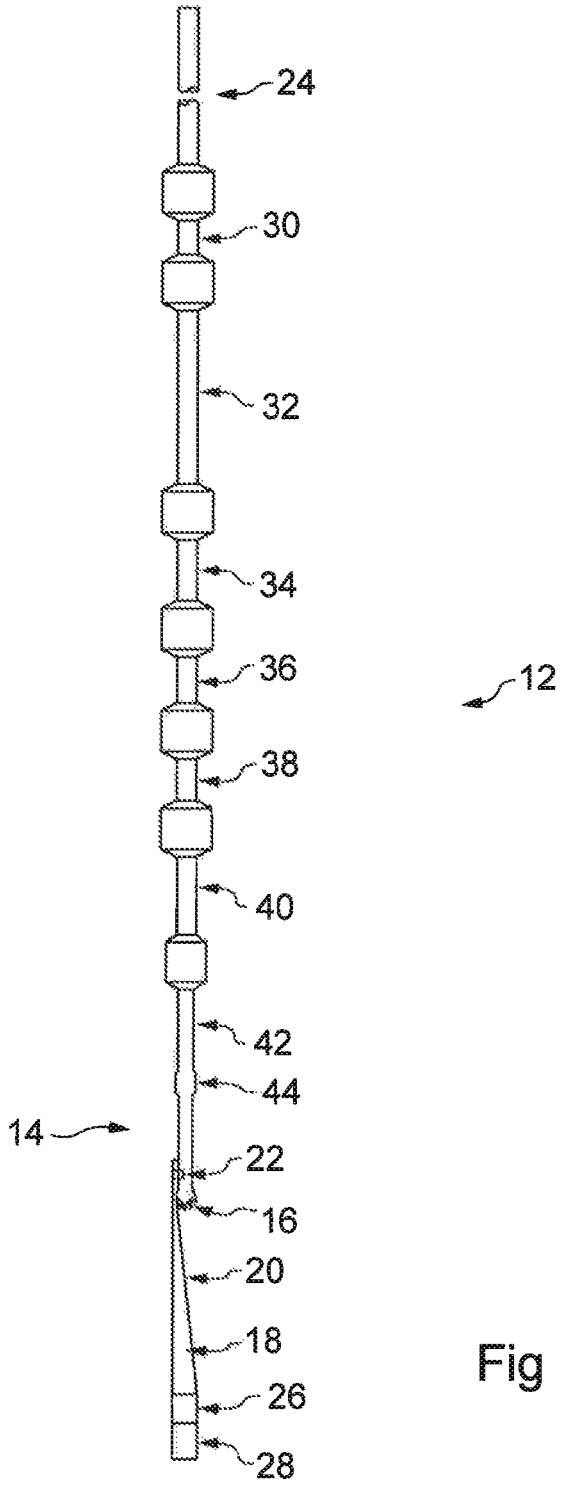
FIG. 2 is a more detailed view of a typical whipstock assembly as shown in FIG. 1, illustrating further components of the assembly and of a drill string coupled to the assembly and extending to surface.

FIG. 2 is a more detailed view of the whipstock assembly 12, illustrating further components of the assembly and of a drill string 24 coupled to the whipstock assembly and extending to surface. The whipstock assembly 12 includes an anchor 26 and a bridge plug 28, which may be used respectively for anchoring the whipstock 18 at a desired location and orientation within the wellbore 10, and sealing the whipstock relative to the wellbore 10 to prevent fluid migration along the wellbore past the whipstock. The following components are provided sequentially between the drill string 24 and the mill 16: heavy weight drill pipe (HWDP) 30; an orientation assembly 32; a spacer sub-34; a float valve 36; a flex joint 38; a bypass valve 40; and tubing 42 coupling the tubing string above to the mill 16. A component 44 is also shown mounted on the tubing 42, which may be a further mill (known as a window mill, as will be discussed below), or optionally a stabiliser. The function and operation of the various components will be well known to persons skilled in the art, and will not be described in further detail here. It will also be understood that the particular combination of components are illustrative and not intended to limit the invention.

Figure 3:
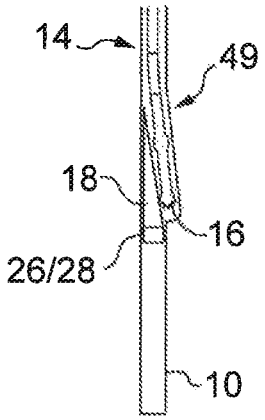
FIGS. 3, 4 and 5 are views of the whipstock assembly shown in FIG. 1, illustrating steps in a known method of deviating the wellbore, in which the deviation procedure is correctly carried out.
Figure 4:
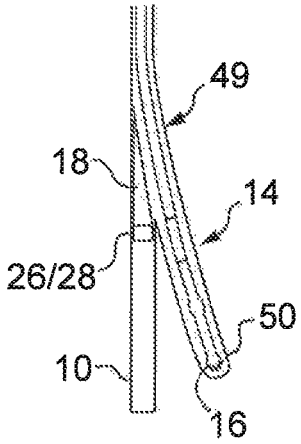
Figure 5:
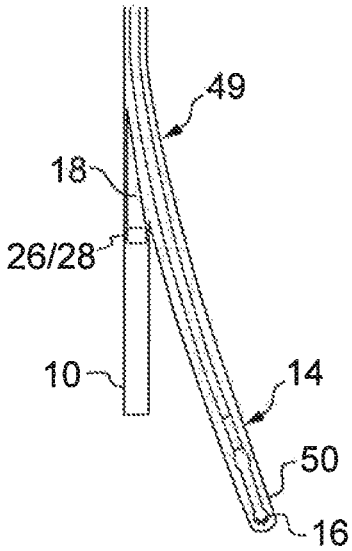

Turning now to FIGS. 3, 4 and 5, there are shown views of the whipstock assembly 12 shown in FIG. 1, illustrating steps in a known method of deviating the wellbore 10, and in which the deviation procedure is correctly carried out. The general steps involved in carrying out the deviation procedure are as follows. The whipstock assembly 12 is made up on the drill floor of a rig 46. This involves releasably connecting the milling assembly 14 to the whipstock 18 using the releasable joint 22. As will be appreciated by persons skilled in the art, the sequence of components required to run the whipstock assembly 12, and the drill string 24, are made-up sequentially on the rig 46 and then deployed into the wellbore 10, suspended from the rig.

The wellbore 10 may be an open hole, but will typically have been lined with metal wellbore-lining tubing known as casing (not shown), which is cemented in place within the wellbore 10. The whipstock assembly 12 is run into the wellbore 10 to a desired location, which will be at a particular depth within the wellbore at which it is to be deviated. A rotational orientation of the whipstock 18 within the wellbore 10 is set, so that the deflection surface 20 of the whipstock is at a desired rotational position. In this way, the deflection surface 20 is oriented at a rotational angle suitable for creating a deviation to the wellbore 10 at a desired orientation.

Following location of the whipstock at the desired depth and rotational position within the wellbore 10, the anchor 26 and bridge plug 28 are activated, to secure the whipstock 20 in that position. The joint 22 takes the form of a shear bolt, which shears when the predetermined axial load is applied. Once the whipstock 18 has been located, and the anchor 26 and bridge plug 28 set, weight can then be applied to the drill string 24 from surface to impart the predetermined axial load on the releasable joint 22. This releases the milling assembly 14 from the whipstock 18, which can then be translated and rotated within the wellbore 10 independently of the whipstock.

FIG. 3 shows the milling assembly 14 following release from the whipstock 18, and commencement of a deviation procedure. As is well known, the milling assembly 14 is operated to drive and rotate the mill 16, either by rotating the drilling string 24 coupled to the milling assembly, or via a downhole motor (not show) connected to the milling assembly or provided as part of the drill string. The milling assembly is then translated within the wellbore 10 in a direction towards the whipstock 18. The inclined deflection surface 20 deflects the mill 16 in a direction towards a wall 48 of the wellbore 10, effectively urging the mill 16, and so the milling assembly 14, in a laterally outward direction away from the wellbore 10. This creates a window 49 in the wellbore wall 48. The milling procedure is continued to form a short length bore 50 which intersects with the wellbore 10, and which is known in the industry as a rathole. Formation of the rathole 50 is illustrated in FIG. 4. It will be understood that further procedural steps may be required both to form the window 49 and the rathole 50, the steps required depending upon whether a single trip whipstock assembly of the type described above is used.

FIG. 5 shows the extension of the rathole 50 a further distance using the milling assembly. On completion of the rathole 50, the milling assembly 14 can be retrieved to surface, and a further, dedicated drilling assembly (not shown) run into the rathole 50 and used to extend the bore, either to form a lateral wellbore extending to a producing formation spaced from the main wellbore 10, or to form a continuation of the wellbore 10, for example in the scenario where a fish has become lodged in the wellbore at a position below the whipstock 18.

Figure 6:
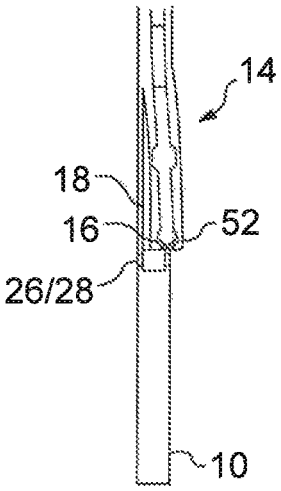
FIGS. 6 and 7 are views of the whipstock assembly shown in FIG. 1, illustrating steps in a known method of deviating the wellbore, in which the deviation procedure is incorrectly carried out.
Figure 7:
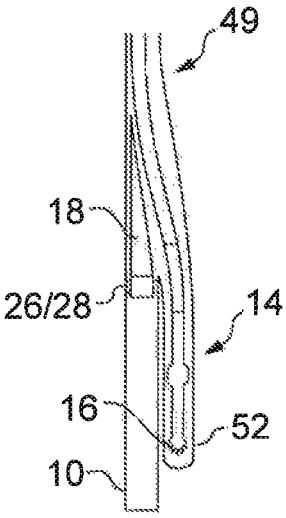

Turning now to FIGS. 6 and 7, there are shown views of the whipstock assembly 12 in a scenario where the deviation procedure has been incorrectly carried out.

FIG. 6 shows a situation in which the mill 16 of the milling assembly 14 has not been correctly deflected by the whipstock 18, and has cut into the deflection surface 20 and through a body of the whipstock 18. The rathole 52 that is then formed does not properly depart from the main wellbore 10. This has resulted in failure of the window and rathole forming process.

FIG. 7 illustrates the situation in which the window 49 has been correctly formed, by deflection of the mill 16 laterally out of the wellbore 10. However, the mill 16 has then been diverted along an incorrect path, which has resulted in the formation of a rathole 52 extending parallel to the main wellbore 10. The rathole forming process has therefore failed.

In the illustrated embodiment, the drill string including the whipstock assembly 12 is rotated from surface, for example by a rotary table (not shown) on the rig 46. This drives the milling assembly 14 coupled to the drill string. However, the drill string may incorporate a downhole motor, for example a mud motor (not shown), provided above and coupled to the milling assembly 14. As is well known, the downhole motor would be operated by fluid pumped down the drill string 12 from surface, and may incorporate a multi cycle valve or equivalent bypass equipment, enabling fluid to bypass around the motor without operating it to rotate the mill 16, until such time as the mill has been released from the whipstock 18.

The milling assembly 14 is the assembly of components which serves for milling the window 49 and the rathole 52. The milling assembly may therefore be taken to comprise the lead mill 16, tubing 42, the further mill/stabiliser 44, and any further mills (which will be discussed below) provided as part of the milling assembly, as well as the releaseable joint 22. Effectively, the milling assembly 14 consists of the lead mill (and releasable joint), and a trailing mill, and the components/equipment located between the mills. Referring to FIG. 2, the milling assembly is effectively the structure extending between and including the further mill/stabiliser 44 and the mill 16.

In the scenarios illustrated in FIGS. 6 and 7, the trajectory of the rathole 52, in one or both of inclination and azimuth, is incorrect. As described in detail above, this has the consequential effect subsequent extension of the rathole 52, as illustrated in FIG. 5 and discussed above, will proceed along an incorrect trajectory, with the disadvantages discussed in the introduction.

Figure 8:
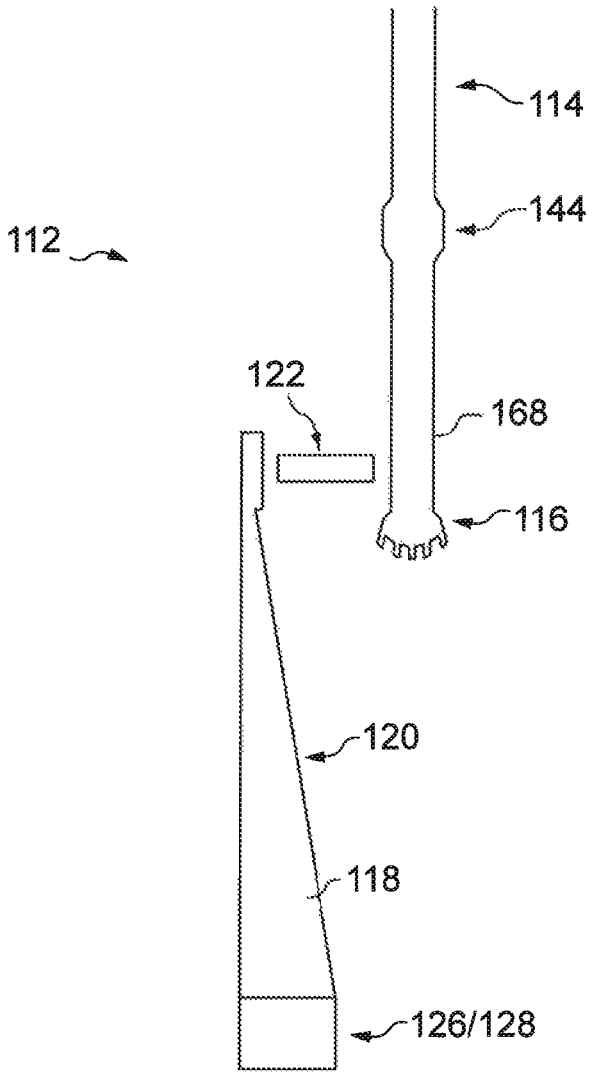
FIG. 8 is a schematic side view of a whipstock assembly in accordance with an embodiment of the present invention.

Turning now to FIG. 8, there is shown a schematic side view of a whipstock assembly in accordance with an embodiment of the present invention, and which has a use in the window and rathole forming process discussed above. The whipstock assembly is indicated generally by reference numeral 112. Like components of the whipstock assembly 112 of the present invention with the prior whipstock assembly 12 shown in FIG. 1 and described above share the same reference numerals incremented by 100.

The whipstock assembly 112 comprises a milling assembly 114 and a whipstock 118 having an inclined deflection surface 120, the milling assembly 114 being releasably connected to the whipstock 120 via a releasable joint 122. It will be understood that the whipstock assembly 112 is shown in FIG. 8 in highly schematic form, for illustration purposes. An anchor 126 is again employed for anchoring the whipstock 118 within the wellbore 10, and the bridge plug 128 is used to isolate the wellbore below the whipstock and may also be used to set the anchor 126. The milling assembly 114 comprises a mill 116 and a further mill or stabiliser 144. It will be understood that, above the milling assembly 114, further components that are shown but not limited to those in FIG. 2, may also be deployed into the wellbore 10 as part of the Bottom Hole Assembly (BHA), via a drill string similar to that shown at 24 in FIG. 2.

Figure 9:
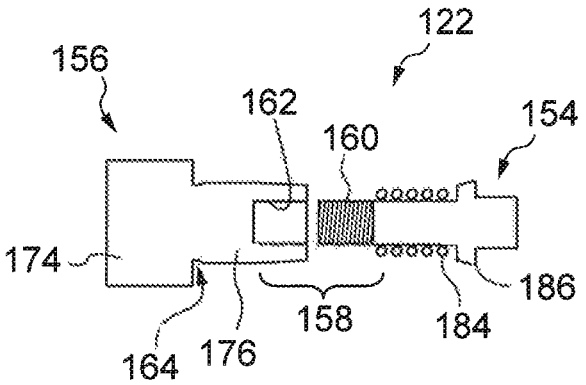
FIG. 9 is an enlarged side view of a releasable joint forming part of the whipstock assembly shown in FIG. 8, with first and second parts of the joint shown in a disconnected state, and illustrating internal features of part of the joint.
Figure 10:
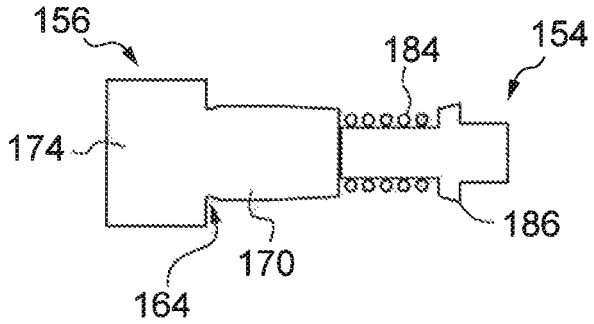
FIG. 10 is a view of the releasable joint shown in FIG. 9, with the first and second parts of the joint shown in a connected state.

Turning now to FIG. 9, there is shown an enlarged view of the releasable joint 122 of the whipstock assembly 122. The releasable joint 122 takes the form of a shear bolt or shear pin, and in its general structure and operation corresponds to known shear bolts. The shear bolt 122 comprises a first part 154 and a second part 156. The first part 154 takes the form of a bolt or pin portion, whilst the second part 156 takes the form of a head portion. A threaded connection 158 is provided between the bolt portion 154 and the head portion 156 which, in the illustrated embodiment, comprises a male thread 160 on the bolt portion 154, and a female thread 162 on the head portion 156, which receives the male thread so that the bolt portion 154 can be secured to the head portion 156. The bolt and head portions 154, 156 are shown in a disconnected state in FIG. 9, and in a connected state in FIG. 10. The shear bolt 122 also comprises a shear zone or line of weakness, which is indicated in the drawing by the numeral 164. In use, the shear bolt 122, in particular the head portion 156, is adapted to shear or break in the shear zone 164.

Figure 11:
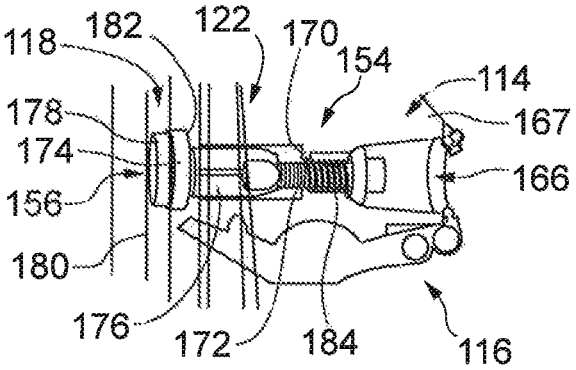
FIG. 11 is a more detailed view of the releasable joint of FIG. 9, shown during use, in which the joint connects a whipstock to a milling assembly of the whipstock assembly shown in FIG. 8.

The bolt portion 154 is mounted to the milling assembly 114, and the head portion 156 is mounted to the whipstock 118, as best shown in the more detailed side view of FIG. 11. The bolt portion 154 is located in a port 166 which extends transversely through a head 167 of the mill 116. An annular shoulder extends into the port 166, and includes an aperture 172 which is shaped to receive the bolt portion 154, the bolt portion passing through the aperture for connection to the head portion 156. This serves for retaining the shear bolt 122 within the mill 116 following shearing.

The head portion 156 comprises a head 174 and a socket 176. The head 174 is located in a port 178 extending from an outer surface 180 of the whipstock 118 in a transverse direction through the whipstock. The whipstock port 178 defines a shoulder 182 which seats the larger diameter head 174, whilst the socket 176 extends through the port 178 for connection to the bolt portion 154, as shown in FIG. 11.

Figure 12:
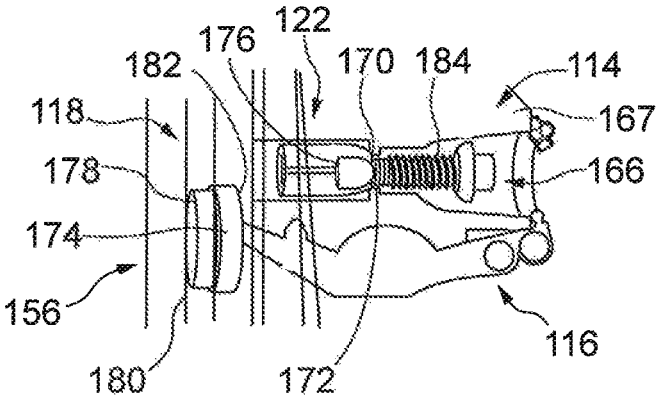
FIG. 12 is a view of the releasable joint shown in FIG. 11, shown during use, and following release of the joint so that the milling assembly is disconnected from the whipstock.

As described above, the milling assembly 114 is released from the whipstock 118 by applying a predetermined axially directed shear load to the shear bolt 122. The shear load is imparted upon the head portion 156 of the shear bolt 122, which shears in the shear zone 164, as shown in FIG. 12. On shearing, the shear bolt 122 separates in to a first section comprising the socket 176 and the attached bolt portion 154 (which is located in the mill 166), and a second section comprising the head 174 of the head portion 156.

A spring 184 is mounted on the bolt portion 154. In the connected state shown in FIG. 11, the spring 184 is compressed between the shoulder 170 and a flange 186 on the bolt portion 154. On shearing, the spring 184 acts to retract the socket 176 from the whipstock socket 176 so that it resides within the port 166 in the mill head 167. The head 174, in contrast, is retained within the whipstock port 178. The milling assembly 114 has therefore been released from the whipstock 118, so that the window and rat hole milling procedure described above can be carried out.

In accordance with the present invention, at least one sensor is provided in the milling assembly 114, for measuring at least one parameter of the rathole 50. A communication device is associated with the at least one sensor, for communicating data relating to the at least one parameter to an operator of the milling assembly 114.

Figure 13:
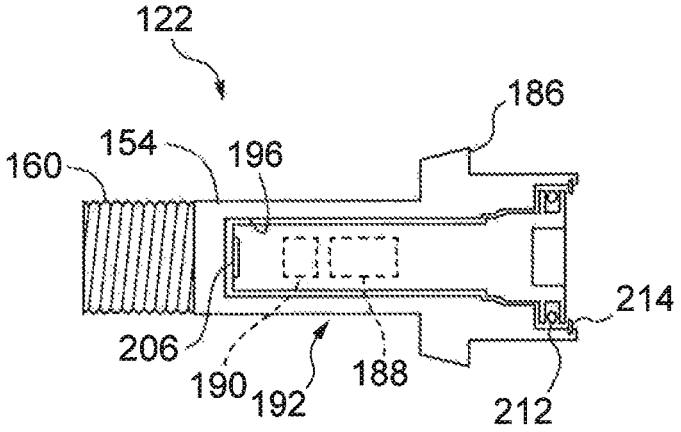
FIG. 13 is a side view part of the releasable joint shown in FIG. 9, illustrating a mounting unit or module containing a sensor and a communication device of the milling assembly shown in FIG. 8.

In the illustrated embodiment, a sensor 188 and communication device 190 are provided, mounted within the shear bolt 122, in particular within the bolt portion 154, as shown in the side view of the bolt portion in FIG. 13. In this way, when the bolt 122 is sheared as discussed above (and shown in FIG. 12), the sensor 188 and communication device 190 are retained within the milling assembly 114, located within the port 166 in the mill head 167. Accordingly, and during subsequent formation and extension of the rathole 50, as shown in FIGS. 4 and 5 and described above, the sensor 188 is able to measure at least one parameter of the rathole 50. The parameter that is measured may relate to the trajectory of the rathole 50, and may include inclination and/or azimuth.

The communication device 190 is connected to the sensor 188, so that parameter data measured by the sensor 188 can be communicated to the operator. In this way, the operator can obtain data relating to the trajectory of the rathole 50, and so can verify that the rathole has been correctly formed prior to extension of the rathole, either to form a lateral wellbore, or to form a continuation of the main wellbore 10.

Figure 14:
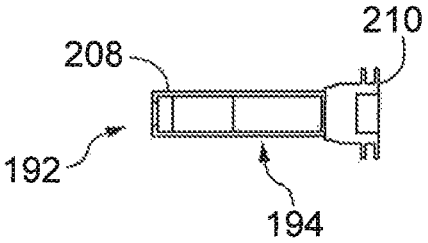
FIG. 14 is a more detailed side view of mounting unit shown in FIG. 13.
Figure 15:
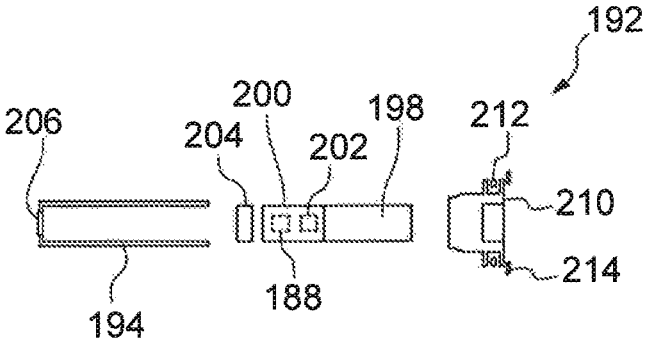
FIG. 15 is an exploded view of the mounting unit shown in FIG. 14.

The sensor 188 and communication device 190 are contained within a mounting unit or module 192, which is shown separately in FIG. 14, and also in the exploded view of FIG. 15. The mounting unit 192 is releasably mountable to a component of the milling assembly 114 which, in the illustrated embodiment, is the shear bolt 122, in particular the bolt portion 154. The mounting unit 192 comprises a housing 194 which fits within a closed bore 196 in the bolt portion 154. The housing 194 contains the sensor 188 and the communication device 190.

A power source in the form of a battery 198 is also contained within the housing 194, and provides electrical power for operating the sensor 188, the communication device 190, and other electrically powered components as will be described below. The sensor 188 forms part of an electronics package 200, which also includes a data storage device in the form of a processor 202. The processor 202 is powered by the battery 198, and stores data relating to parameters measured by the sensor 188.

The communication device 190 is shown schematically in FIG. 13. As better shown in FIG. 15, the communication device 190 comprises a communication interface 204 associated with the processor 202, and a data transmitter in the form of a wireless communicator 206. The communication interface 204 receives data from the processor 202 and is coupled to the wireless communicator 206 for transmitting the parameter data to the operator. Power for operating the communication interface 204, and the wireless communicator 206, is provided by the battery 198.

The housing 194 of the mounting unit 192 comprises a housing body 208 which contains the sensor 188, battery 198, electronics package 200, communication interface 204 and wireless communicator 206. The wireless communicator 206 may, however, be mounted on or through the housing 194, to facilitate data transmission. The housing 194 also comprises a housing cap or plug 210, which is sealingly coupled to the housing body 208. This serves for isolating the components contained within the housing body 208 from wellbore fluid exterior to the housing 194. The mounting unit 192 is mounted within the bore 196 of the bolt portion 154, and is sealed relative to the bolt portion via an O-ring seal or the like 212, and secured in position using a retainer such as a circlip 214. The mounting of the various components within the mounting unit 192 provides the advantage that the mounting unit (and so the components) can easily be removed from the bolt portion 154, and so released from the milling assembly 114, for example to perform maintenance and/or replacement of any of the components contained within the mounting unit.

As described above, the sensor 188 is of a type which is suitable for providing trajectory data relating to the rathole 50. It may be preferred to measure both angular tilt (and so inclination of the rathole 50), as well as azimuth. This enables verification that the rathole 50 has extended at a desired inclination angle relative to the main wellbore 10, as well as at the desired azimuth. To this end, the sensor 188 may comprises both an accelerometer (used for measuring inclination) and a gyroscopic sensor (for measuring azimuth), or equivalent sensors which are capable of performing these functions.

Further sensors may be provided for measuring additional parameters. Exemplary sensors include: sensors that are capable of measuring inertia such as in directional milling/drilling, and/or for measuring vibration during milling/drilling operations; temperature sensors; magnetometers (which may be used for measuring fluctuations in the magnetic field e.g. in surrounding medium); pressure sensors; vibration monitoring sensors; and shock loading monitoring sensors. A resistivity sensor may be provided, which may be for measuring resistivity of the surrounding formation or the resistivity in metal (e.g. casing) surrounding the milling assembly.

It may be preferred to transmit data relating to the parameter measured by the sensor 188 to surface real-time. This may be achieved using known communication techniques such as: fluid pressure pulses in fluid contained in the wellbore (e.g. mud pulse telemetry); and electromagnetic or acoustic/sonic telemetry (e.g. transmitted along tubing coupled to the milling assembly 114 and extending to surface). In these situations, data may be transmitted by the wireless communicator 206 to a downhole receiver provided as part of the milling assembly 114 or the drill string 24, which may subsequently transmit the data to surface. For example, where mud pulse telemetry is employed, the data may be transmitted to a mud pulse telemetry device (not shown), which transmits the data in the form of fluid pressure pulses through fluid contained in the wellbore 10. Where electromagnetic or acoustic/sonic telemetry is employed, the data may be transmitted to a suitable receiver provided in the milling assembly 114/drill string 24, and transmitted to the surface via one or more repeaters.

In a variation on the embodiments shown in FIGS. 13 to 15, data measured by the sensor 188 may be recovered at surface, for example by direct connection to the communication interface 204, such as via a hard electrical connection. This requires that the milling assembly 114 be recovered to surface. Following verification that the rathole 50 has followed the correct trajectory, suitable milling/drilling equipment would then be deployed into the well to complete the deviation procedure. Whilst a direct connection at surface may be employed, it will be understood that wireless transmission of data at surface may equally be used.

FIG. 16 is a side view of part of an alternative releasable joint, similar to that shown in FIG. 13, in which components are mounted within the bore 196 of the bolt portion 154 without the aid of the housing 194. As can be seen from the drawing, the battery 198, electronics package 200 (comprising the sensor 188 and processor 202), communication interface 204 and wireless communicator 206 are all mounted within the bore 196, closed and sealed in the bore by the cap 210. The wireless communicator 206 may be replaced with a hard electrical connection for downloading the data at surface.

In the embodiments of both FIGS. 13 and 16, the arrangement of the bolt portion 154 and head portion 156 of the shear bolt 122 may be reversed, so that the bolt portion is mounted to the whipstock 118 and the head portion is mounted to the milling assembly 114. In this situation, the mounting unit 192 of FIG. 13 would be located in the head portion 156, or the components shown in FIG. 16 and described above would be located in the head portion 156.

The invention is not restricted to requiring that the sensor 188 and communication device 190 be provided in the mill 116 of the milling assembly 114. The sensor 188 and the communication device 190 may therefore be provided in other parts or components of the milling assembly 114. It will be understood from the discussion of FIGS. 13 to 16 that this may involve locating the mounting unit 192, or the various components shown in FIG. 16, in some other part or component of the milling assembly 114. Exemplary alternatives are shown in FIGS. 17 and 18 and will now be described.

FIG. 17 is a side view of an alternative milling assembly, indicated generally by reference numeral **114*a*. Like components of the milling assembly 114*a* with the milling assembly 114 shown in FIG. 8** share the same reference numerals with the addition of the suffix "a".

The milling assembly **114*a* includes a first mill in the form of a starter mill 116*a* provided at a leading end 216 of the milling assembly, which is the end disposed furthest from the surface during use. The milling assembly 114*a* also comprises two further mills, in the form of window mills 218 and 220. The starter mill 116*a* is used to form the window 49, rathole 50, and to extend the rathole as described above. The window mills 218 and 220 are used to enlarge and dress the window 49, to ease passage of the milling assembly 114*a*, as well as the drill string 24** and/or subsequent tubing strings or components, through the window.

In this embodiment, the sensor 188, processor 202 and communication device 190 (and suitably also the battery 198, electronics package 200, communication interface 204, and wireless communicator 206/hard electrical connection) are mounted within one or more of the starter mill **116*a*, window mill 218 and window mill 220, and closed and sealed in the bore by cap 210 as shown in the enlarged view of FIG. 17A, which shows part of a body 221 of the relevant window mill. The mounting in each case is similar, within a closed bore 196*a* formed in the body 221** of the relevant mill.

Optionally, only one of the window mills 218/220 may be provided. Also, a stabiliser could conceivably be provided between the starter mill 116*a* and the window mill 218, and/or between the window mills 218 and 220. The stabiliser (s), if provided, could incorporate the sensor. Where a stabiliser is provided which incorporates the sensor, then the sensor 188, processor 202 and communication device 190 (and suitably also the battery 198, electronics package 200, communication interface 204, and wireless communicator 206/hard electrical connection) would typically be mounted within one or more of stabilisers, and closed and sealed in a bore in the stabiliser by cap 210. The mounting in each case would be similar, within a closed bore formed in the body of the stabiliser.

In a variation, which is shown in FIG. 17, the sensor can be housed in an instrument sub (a short tubular body) provided as part of the milling assembly 114*a*, for example in an optional instrument sub 230 provided between the starter mill 116*a* and the window mill 218, or in an optional instrument sub 232 provided between the window mills 218 and 220. The sensor 188, processor 202 and communication device 190 (and suitably also the battery 198, electronics package 200, communication interface 204, and wireless communicator 206/hard electrical connection), as shown in FIG. 17A, may be mounted within the instrument sub or subs 230 and/or 232.

Whilst a whipstock assembly of the present invention has been shown in the drawings and described above, it will be understood that the invention extends to a releasable joint comprising the sensor and communication device; a mill comprising the sensor and communication device; and a stabiliser comprising the sensor and communication device. The invention also extends to a method of deviating a wellbore of a well and verifying a trajectory of the deviation, having method steps which will be apparent from the foregoing description.

The present invention enables the trajectory of a rathole to be measured during its formation, and data relating to the trajectory to be communicated to an operator of the milling assembly. If the trajectory is found to be correct then the rathole can be extended using a suitable milling/drilling assembly (to deviate the wellbore) with confidence that the rathole has been formed correctly and so that the extension is also on the correct trajectory. If however the trajectory is found to be incorrect, for example if one or both of the inclination and the azimuth is incorrect, then steps can be taken to correct the trajectory prior to extension of the rathole along the wrong trajectory. The present invention therefore provides significant advantages over prior procedures which do not enable verification of the trajectory prior to extension of a rathole.

Various modifications may be made to the foregoing without departing from the spirit or scope of the present invention.

Reference is made in this document to the at least one sensor (and other components) being provided in the milling assembly. It will be understood that this should not necessarily be taken to mean that the at least one sensor is mounted within a structure of the milling assembly, and so that said sensor may, for example, be mounted on a surface of the milling assembly.

A plurality of sensors may be provided. Each sensor may be adapted to measure a different parameter of the rathole. A plurality of sensors may be provided for measuring the same parameter, which may provide a degree of redundancy and/or verification of parameter data.

Where the whipstock assembly comprises a plurality of sensors, different sensors may be mounted to or within different components, which components may be selected from the releasable joint, mill and stabiliser discussed above.

The at least one sensor may be selected from the group comprising: an accelerometer (which may be used for measuring angular tilt and so inclination of the rathole, for measuring inertia such as in directional milling/drilling, and/or for measuring vibration during milling/drilling operations); a temperature sensor; a magnetometer (which may be used for measuring fluctuations in the magnetic field e.g. in surrounding medium); a pressure sensor; a gyroscopic sensor (which may be used for measuring azimuth); a vibration monitoring sensor; a shock monitoring sensor; and a sensor which measures at least one formation parameter, which may be selected from the group comprising gamma ray/radiation, porosity and density. Where there are a plurality of sensors, the sensors may be selected from this group.

At least one sensor may measure a milling parameter, which may be a parameter relating to a milling procedure. Measurement of the milling parameter may be achieved using a vibration monitoring sensor and/or a shock monitoring sensor, which may measure vibration and/or shock loading on or in the mill. Excessive vibration of or in the mill, for example due to too high a weight and/or torque being applied, may be undesirable. In particular, such may result in a poor cut of a window, with sharp edges or ledges that are likely to cause problems when a tool or tubing is subsequently passed from the wellbore into the rathole. A sensor for measuring one or more of rotation, torque and weight of or on the mill may be provided.

The communication interface may by connectable to a further communication interface by a non-contact method, including but not limited to an inductive coupling and an optical coupling.

The invention claimed is:

1. A whipstock assembly for use in deviating a wellbore of a well, the whipstock assembly comprising:

a whipstock having an inclined deflection surface;

a milling assembly comprising a mill for milling a window in a wall of the wellbore and forming a rathole extending from the wellbore, wherein the milling assembly is defined by the mill, which is a lead mill, a further mill and a structure extending between the lead mill and the further mill;

a releasable joint by which the milling assembly is releasably connected to the whipstock, so that the milling assembly can be separated from the whipstock within the wellbore and subsequently deflected towards the wall of the wellbore by the inclined deflection surface of the whipstock;

at least one sensor provided in the milling assembly, for measuring at least one parameter of the rathole, the at least one parameter relating to a trajectory of the rathole;

and a communication device associated with the at least one sensor, for communicating data relating to the at least one parameter to an operator of the milling assembly, wherein the at least one sensor and the communication device are mounted within the releasable joint.

2. The whipstock assembly as claimed in claim 1, in which the at least one sensor comprises an azimuth monitoring sensor for monitoring an azimuth of the rathole.

3. The whipstock assembly as claimed in claim 1, in which at least one additional sensor is further provided which is for monitoring a milling parameter.

4. The whipstock assembly as claimed in claim 3, in which the at least one additional sensor is selected from the group comprising: a vibration monitoring sensor; a shock monitoring sensor; and a sensor for measuring one or more of rotation, torque and weight of or on the mill.

5. The whipstock assembly as claimed in claim 1, in which at least one sensor is provided which is for measuring at least one formation parameter, the parameter selected from the group comprising gamma ray/radiation, porosity and density.

6. The whipstock assembly as claimed in claim 1, in which the releasable joint comprises a first part mounted to the milling assembly and a second part mounted to the whipstock.

7. The whipstock assembly as claimed in claim 6, in which the releasable joint is a shear bolt, one of the first and second parts being a bolt portion, and the other one of the first and second parts being a head portion, a shear zone being provided on the head portion which, on shearing, separates the joint into a first section comprising a part of the head portion and a second section comprising a further part of the head portion and the bolt portion.

8. The whipstock assembly as claimed in claim 1, comprising a source of power for providing power to operate the at least one sensor and the communication device, in which the power source is provided in the milling assembly.

9. The whipstock assembly as claimed in claim 1, comprising a data storage device associated with the sensor for storing the data, the data storage device being provided in the milling assembly.

10. The whipstock assembly as claimed in claim 9, in which the communication device comprises a communication interface associated with the data storage device, for receiving the data.

11. The whipstock assembly as claimed in claim 10, in which the communication device comprises a data transmitter for transmitting data to the operator, the data transmitter being associated with the communication interface for receiving data from the data storage device.

12. The whipstock assembly as claimed in claim 10, in which the communication interface is adapted to be connected to a further data interface so that the data can be downloaded.

13. The whipstock assembly as claimed in claim 1, wherein the at least one sensor comprises an inclination monitoring sensor.

14. A whipstock assembly for use in deviating a wellbore of a well, the whipstock assembly comprising:

a whipstock having an inclined deflection surface;

a milling assembly comprising a mill for milling a window in a wall of the wellbore and forming a rathole extending from the wellbore;

a releasable joint by which the milling assembly is releasably connected to the whipstock, so that the milling assembly can be separated from the whipstock within the wellbore and subsequently deflected towards the wall of the wellbore by the inclined deflection surface of the whipstock;

at least one sensor provided in the milling assembly for measuring at least one parameter of the rathole, the at least one parameter relating to a trajectory of the rathole; and a communication device associated with the at least one sensor, for communicating data relating to the at least one parameter to an operator of the milling assembly, in which the at least one sensor and the communication device are mounted within the releasable joint.

15. The whipstock assembly as claimed in claim 14, in which the releasable joint comprises a first part mounted to the milling assembly and a second part mounted to the whipstock, and in which the at least one sensor and the communication device are mounted within the first part of the releasable joint.

16. The whipstock assembly as claimed in claim 15, comprising a mounting unit containing the at least one sensor and the communication device, the mounting unit being releasably mountable within the first part of the releasable joint.

17. A releasable joint for releasably connecting a milling assembly to a whipstock, the releasable joint comprising:

a first part adapted to be mounted to the milling assembly;

a second part adapted to be mounted to the whipstock;

a shear zone adapted to shear on application of a predetermined load, to separate the first part from the second part and so disconnect the milling assembly from the whipstock;

at least one sensor for measuring at least one parameter of a well; and a communication device associated with the at least one sensor, for communicating data relating to the at least one parameter to an operator of the milling assembly;

in which the at least one sensor and the communication device are provided in the first part of the releasable joint.

18. A method of deviating a wellbore of a well and verifying a trajectory of the deviation, the method comprising the steps of:

connecting a milling assembly to a whipstock using a releasable joint, to form a whipstock assembly comprising the milling assembly and the whipstock, wherein the milling assembly is defined by a lead mill, a further mill and a structure extending between the lead mill and the further mill;

deploying the whipstock assembly into the wellbore;

positioning the whipstock at a desired location within the wellbore and subsequently disconnecting the milling assembly from the whipstock by releasing the releasable joint;

translating the milling assembly within the wellbore in a direction towards the whipstock, so that the lead mill of the milling assembly is deflected towards a wall of the wellbore by a deflection surface of the whipstock;

activating the lead mill to form a window in the wall of the wellbore, and subsequently forming a rathole extending from the wellbore;

operating at least one inclination monitoring sensor provided in the milling assembly whilst the milling assembly is located in the rathole to measure at least one parameter of the rathole, the at least one parameter relating to a trajectory of the rathole; and communicating data relating to the at least one parameter to an operator via a communication device associated with the at least one inclination monitoring sensor, and verifying the trajectory of the rathole, wherein the inclination monitoring sensor and the communication device are provided in the releasable joint.

* * * * *